US006712460B2

(12) United States Patent
Ohashi et al.

(10) Patent No.: US 6,712,460 B2
(45) Date of Patent: Mar. 30, 2004

(54) INKJET PRINTING HEAD

(75) Inventors: Tetsuya Ohashi, Chiba (JP); Naoji Otsuka, Kanagawa (JP); Hiroyuki Inoue, Kanagawa (JP); Hiroyuki Ishinaga, Tokyo (JP); Nobuyuki Kuwabara, Tokyo (JP); Masahito Yoshida, Saitama (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,194

(22) Filed: Aug. 12, 2002

(65) Prior Publication Data

US 2003/0052950 A1 Mar. 20, 2003

(30) Foreign Application Priority Data

Aug. 14, 2001 (JP) ..... 2001-246240

(51) Int. Cl.[7] ..... B41J 21/175
(52) U.S. Cl. ..... 347/86
(58) Field of Search ..... 347/84, 85–87, 347/94

(56) References Cited

U.S. PATENT DOCUMENTS 5,565,899 A 10/1996 Sugimoto et al.
5,764,259 A * 6/1998 Nakajima ..... 347/86
5,912,688 A * 6/1999 Gragg ..... 347/86
6,003,984 A * 12/1999 Bohorquez et al. ..... 347/86
6,109,734 A 8/2000 Kashino et al.
6,179,412 B1 1/2001 Ishinaga et al.
6,447,093 B1 9/2002 Asakawa et al.
6,494,568 B2 * 12/2002 Hou et al. ..... 347/86
6,582,069 B2 6/2003 Ohashi et al. ..... 347/94

OTHER PUBLICATIONS

U.S. patent application Ser. No. 09/941,775, Tetsuya Ohashi, Yutaka Koizumi, Hiroyuki Kigami, Satoshi Shimazu, filed Aug. 30, 2001.

* cited by examiner

*Primary Examiner*—Shih-Wen Hsieh
*Assistant Examiner*—An H. Do
(74) *Attorney, Agent, or Firm*—Fitzpatrick, Cella, Harper & Scinto

(57) ABSTRACT

There is provided an inkjet printing head carrying a sub-tank from which accumulated gases can be easily discharged. The inkjet printing head includes a sub-tank which has a movable section constituted by a deformable film sheet, a spring for generating a negative pressure, and a supply/discharge channel for supplying ink and discharging accumulated gases. The sub-tank is intermittently supplied with ink from a main tank and reserving the ink. The supply/discharge channel is provided in a position where it does not interfere with the movable section and the spring, e.g., in a frame of the sub-tank. The supply/discharge channel is preferably formed in an upper part of the sub-tank, e.g., a ceiling section of the sub-tank.

10 Claims, 16 Drawing Sheets

INKJET PRINTING HEAD

This application is based on Patent Application No. 2001-246240 filed Aug. 14, 2001 in Japan, the content of which is incorporated hereinto by reference

BACKGROUND OF THE INVENTION

1. Field of the Invention

The present invention relates to a sub-tank of an inkjet printing head and, more particularly, to an inkjet printing head having a mechanism for discharging gases that have entered and accumulated in the sub-tank.

2. Description of the Related Art

In an enclosed type liquid container, gases that have been dissolved in a liquid in the container and gases that have passed through members of the container from outside are accumulated with the passage of time. An increase in the quantity of gases in the liquid container cancels a negative pressure required for holding the liquid in the container. Especially, in the case of an inkjet printing head having such an enclosed type light container, this disables proper ejection of the liquid and results in leakage of the liquid from the nozzle.

A countermeasure to this problem is to minimize gases trapped in the liquid container by employing materials having low gas permeability as materials of members used for the container, but it is still insufficient to eliminate the accumulated gases completely.

Referring to inkjet cartridges that are one type of liquid containers in the related art, such cartridges are frequently replaced when liquids in the liquid containers have run out, and the above problem has been avoided by replacing the cartridges in most cases. In such cases, however, the cartridges must be thrown away with liquids left in the containers, which undesirably results in the waste of containers and liquids. In the case of inkjet cartridges that are used with liquids repeatedly being charged, the above-described situation remains and there is no solution to this problem at all.

Another possible countermeasure to the problem is to discharge the accumulated gases to the outside periodically. However, when this is attempted by taking advantage of a recovery operation in the related art for sucking a liquid from a nozzle, the accumulated gases cannot be discharged efficiently because a liquid in the container is also discharged, and only the gases may finally remain in the container.

A possible measure to avoid this is to form a channel for communication with outside separately from an ink channel to a nozzle. A discharge port provided at the bottom of a liquid container sufficiently works as a channel for charging a liquid. However, when the accumulated gases are discharged, the liquid is discharged first, leaving the accumulated gases without discharging the gases as in the case of the recovery operation in the related art. Even if a chimney-like configuration is employed in which the opening of the channel is located at the top of the container, a consuming efficiency of a liquid can be decreased in the case of a container having a movable section constituted by a sheet, for example, because the chimney can impair the movability of the sheet depending on the position where the chimney is formed.

SUMMARY OF THE INVENTION

The present invention confronts the above problems and provides an inkjet printing head having a liquid container from which the accumulated gases can be easily discharged.

According to the present invention this is achieved in an inkjet printing head, characterized in that it has a movable section constituted by a deformable film sheet, a spring for imparting a negative pressure, and a sub-tank having a supply/discharge channel for supplying ink and discharging accumulated gases, the sub-tank being intermittently supplied with ink from a main tank and reserving the ink, and in that the supply/discharge channel is provided in a position where it does not interfere with the movable section and the spring.

The sub-tank may have a frame, and the supply/discharge channel may be formed in the frame.

An opening of the supply/discharge channel is preferably formed in an upper part of the sub-tank, and the opening may be formed at a ceiling section of the sub-tank.

The ceiling section of the sub-tank may be inclined toward the opening of the supply/discharge channel.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will now be described in detail with reference to the drawings.

(Example of Structure of Inkjet Printing Apparatus)

Figure 1:
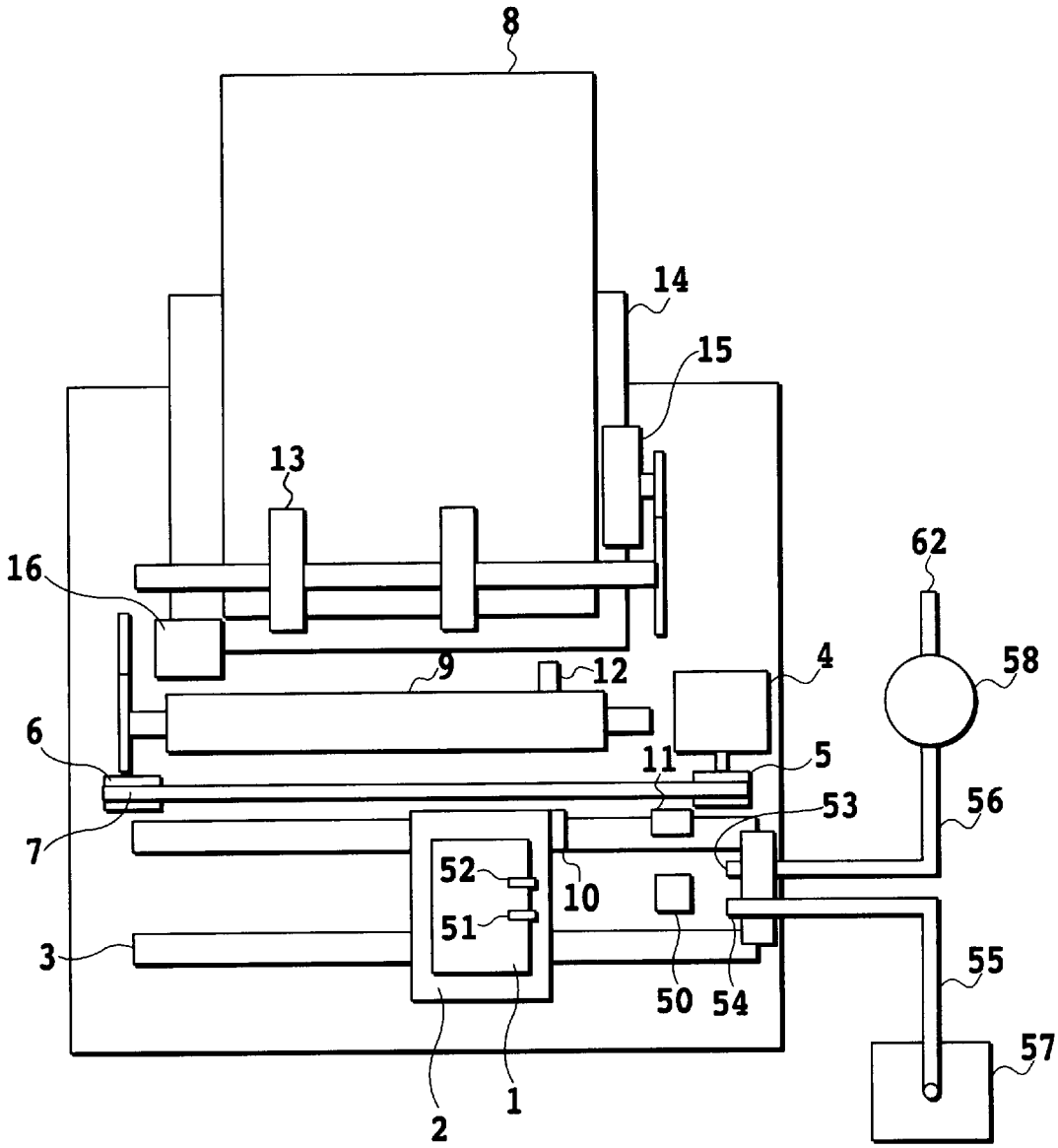
FIG. 1 is a schematic plan view showing a general structure of an inkjet printing apparatus having an ink intermittent supply system utilizing a sub-tank according to the present invention.

FIG. 1 is a schematic plan view showing a general structure of an inkjet printing apparatus having an intermittent ink supply system utilizing a sub-tank according to the present invention.

In the structure in FIG. 1, a printing head unit 1 is replaceably mounted on a carriage 2. The printing head unit 1 has a plurality of printing heads and an ink tank container or chamber which contains a plurality of ink tanks (also referred to as "second ink tanks" or "sub-tanks" in relation to first ink tanks or main tanks described later) for directly supplying ink to the plurality of printing heads, and there is provided a connector (not shown) for transmitting signals such as a drive signal for driving the head section to cause an ink ejecting operation of a nozzle. The carriage 2 on which the printing head unit 1 is positioned and replaceably mounted is provided with a connector holder (electrical connecting section) for transmitting signals such as the drive signal to the printing head unit 1 through the connector.

The carriage 2 is guided and supported by a guide shaft 3 provided on a main body of the apparatus and extending in a main scanning direction such that it can be moved back and forth along the guide shaft. The carriage 2 is driven and controlled with respect to its position and movement by a main scanning motor 4 through transmission mechanisms such as a motor pulley 5, a driven pulley 6, and a timing belt 7. For example, a home position sensor 10 in the form of a transmission type photo-interrupter is provided, and a blocking plate 11 is disposed in a fixed part of the apparatus associated with a home position of the carriage such that it can block an optical axis of the transmission type photo-interrupter. Thus, when the home position sensor 10 passes through the blocking plate 11 as a result of the movement of the carriage 2, the home position is detected, and the position and movement of the carriage can be controlled using the detected position as a reference.

Printing medium 8 that are printing paper or plastic sheets are separately fed one by one from an automatic sheet feeder (hereinafter referred to as an ASF)14 by rotating a pick-up roller 13 with an ASF motor 15 through a gear. Further, the medium is transported through a position (printing section) in a face-to-face relationship with a surface of the printing head unit 1 where ejection openings are formed as a result of the rotation of a transport roller 9 (sub scanning). The transport roller 9 is driven by transmitting the rotation of a line feed (LF) motor 16 through a gear.

At this time, judgment on whether the paper has been fed and decision of a print starting position on the printing medium in a sub scanning direction is performed based on output of a paper end sensor 12 for detecting the presence of a printing medium disposed upstream of a printing position on a printing medium transport path. The paper end sensor 12 is used to detect a rear end of a printing medium 8 and to decide a final printing position on the printing medium in the sub scanning direction based on the detection output.

The printing medium 8 is supported by a platen (not shown) at a bottom surface thereof such that a flat surface is formed in a portion thereof to be printed. In doing so, the printing head unit 1 carried by the carriage 2 is held such that the surface thereof where the ejection openings are formed protrudes downward from the carriage in parallel with the printing medium 8. For example, the printing head unit 1 is an inkjet printing head unit having a structure for ejecting ink utilizing thermal energy and having an electrothermal transducer for generating thermal energy that causes film boiling of ink. That is, the printing head of the printing head unit 1 performs printing by utilizing the pressure of bubbles generated as a result of film boiling of ink caused by the thermal energy applied by the electrothermal transducer to eject ink. Obviously, a different type of unit such as a unit that ejects ink utilizing a piezoelectric device may be used.

Reference numeral 50 represents a recovery system mechanism that has a cap member used for an operation of recovering suction of ink from the printing head unit 1 and for protecting the surface of the printing head where the ejection openings are formed. The cap member can be set in positions where it is joined to and detached from the surface where the ejection openings are formed by a motor that is not shown. Operations such as the suction recovery operation of the printing head are performed by generating a negative pressure in the cap member by a suction pump which is not shown in the joined state. The surface of the printing head where the ejection openings are formed can be protected by keeping the cap member in the joined state when the printing apparatus is not used.

Reference numeral 51 represents a valve unit provided on the printing head unit side for coupling the printing head unit 1 to a first ink tank (hereinafter referred to as a main tank). Reference numeral 54 represents a valve unit provided at the ink supply source side to be paired with the valve unit 51. Reference numeral 52 represents a valve unit provided on the printing head unit side for coupling the printing head unit 1 to an air pump unit. Reference numeral 53 represents a valve unit provided on an air pump unit side to be paired with the valve unit 52.

The valve units 51 through 54 are in contact and coupled with the respective valve units to allow ink and air to flow between the valve units when the carriage 2 is located at the home position outside a printing area in the main scanning direction or at a position in the vicinity of the same. The valve units are decoupled from each other when the carriage 2 moves away the position toward the printing area, and the valve units 51 and 54 automatically enter a closed state as a result of the decoupling. On the contrary, the valve unit 52 is always in an open state.

Reference numeral 55 represents a tube member that is coupled with a main tank 57 to supply ink to the valve unit 54. Reference numeral 56 represents a tube member for an air pressure or pneumatic circuit, the tube member 56 being coupled with a pump unit 58 for pressurization and depressurization. Reference numeral 62 represents a suction and exhaust port of the pump unit 58.

It is not essential to configure each of the tube members as an integral unit, and it may be configured by combining a plurality of tube elements. A plurality of first and second ink tanks, tubes and valve units communicating therebetween are provided, corresponding to the number of printing heads.

(Another Example of Structure of Inkjet Printing Apparatus)

The intermittent supply system in FIG. 1 has a structure in which the valve units are coupled only when the second ink tank is charged with ink and in which the ink supply system between the first and second ink tanks is spatially disconnected during a printing operation. An intermittent supply system may be employed in which the ink channel or a fluid path is blocked with a valve instead of such disconnection to achieve fluid isolation between the first and second ink tanks.

Figure 2:
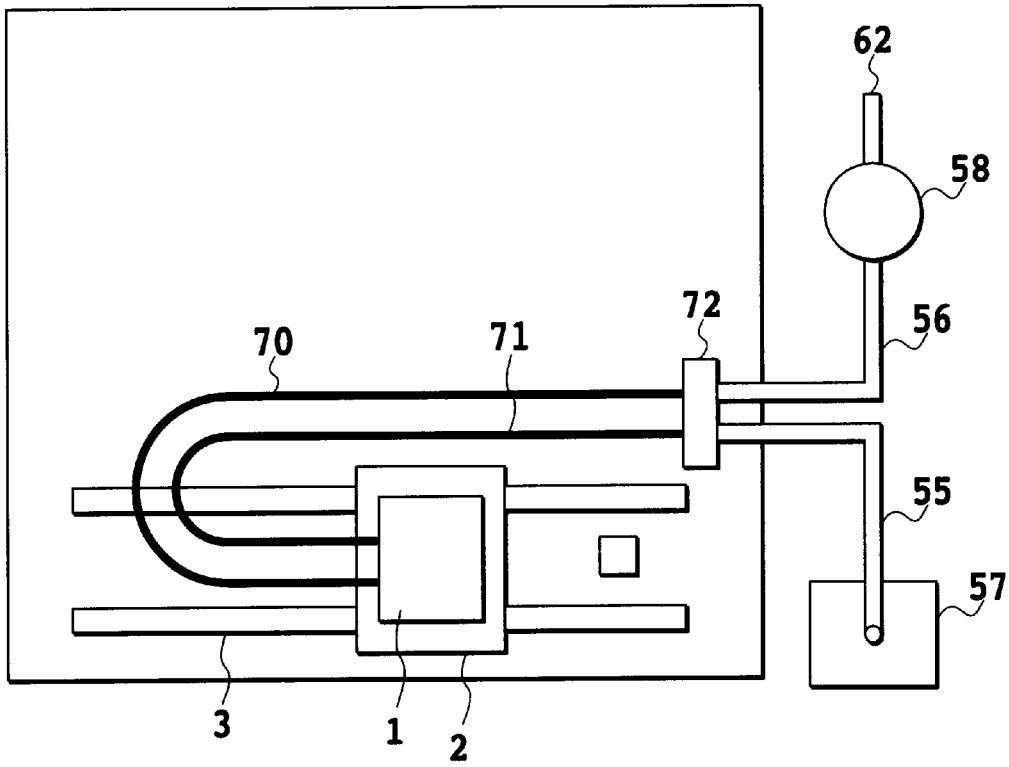
FIG. 2 schematically shows an inkjet printing apparatus utilizing an intermittent supply system that employs a normally connected tube mechanism.

FIG. 2 schematically shows an inkjet printing apparatus in which an intermittent supply system utilizing a normally connected tube mechanism is used. For simplicity, FIG. 2 does not show parts which can be configured similarly to those in FIG. 1 and which are not related to the description of the supply system of the present example.

In FIG. 2, reference numeral 70 represents a flexible tube for an air pressure circuit that is connected to a second ink tank of a printing head unit at one end thereof and connected to a pump unit 58 for pressurization and depressurization through an electromagnetic valve unit 72 and a tube member 56 for the air pressure circuit at another end thereof. Reference numeral 71 represents a flexible tube for supplying ink that is connected to the second ink tank of the printing head unit at one end thereof and connected to first ink tank 57 through the electromagnetic valve unit 72 and a tube member 55 for supplying ink at another end thereof.

That is, an intermittent supply system may be configured even using such a normally connected tube mechanism by interposing units for opening to form and closing to block a channel such as the electromagnetic valve unit 72 and by controlling the opening and closing of the same appropriately during an operation of charging the second ink tank with ink and a printing operation.

(Sub-tank and Manufacturing Method Thereof)

Here, a sub-tank (a second ink tank) to which an accumulated gas discharge mechanism according to the present invention is applied and a manufacturing method thereof will be described with reference to FIGS. 9–16.

Figure 9:
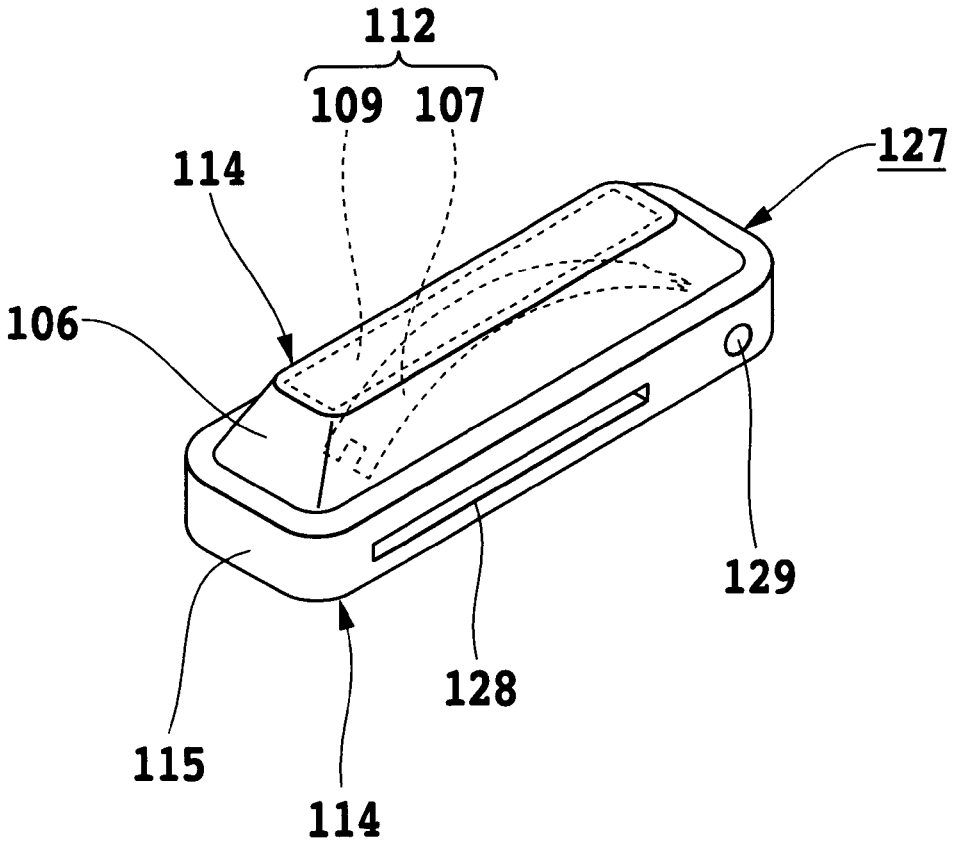
FIG. 9 is a perspective view of an ink tank (sub-tank) according to the present invention.

FIG. 9 is a perspective view of an ink tank (a sub-tank) 127 manufactured through steps as described below, the tank having an enclosed structure in which top and bottom spring/sheet units 114 are mounted to openings at the top and bottom of a square frame 115. As will be described later, the spring/sheet unit 114 is constituted by a spring unit 112 including a spring 107 and a pressure plate 109 and a flexible tank sheet (flexible member) 106. The frame 115 is formed with a first ink supply port 128 for supplying ink from the ink tank 127 to a printing head and a second ink supply port 129 for introducing ink from a main tank to the ink tank 127.

FIGS. 10A to 14B illustrate a method of manufacturing such an ink tank 127.

Figure 10A:
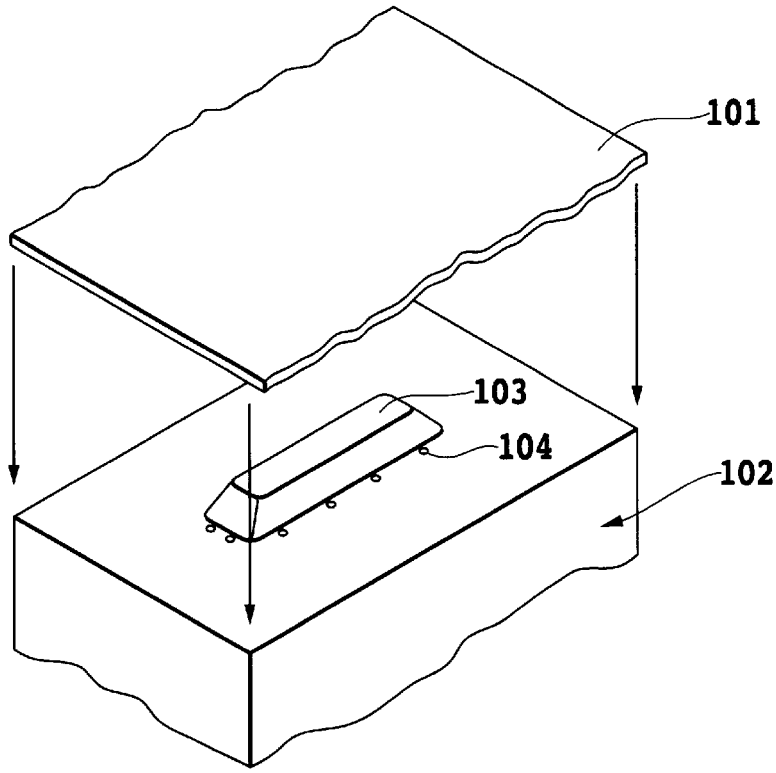
FIGS. 10A, 10B and 10C are illustrations of a step of molding a tank sheet of the ink tank in FIG. 9.
Figure 10B:
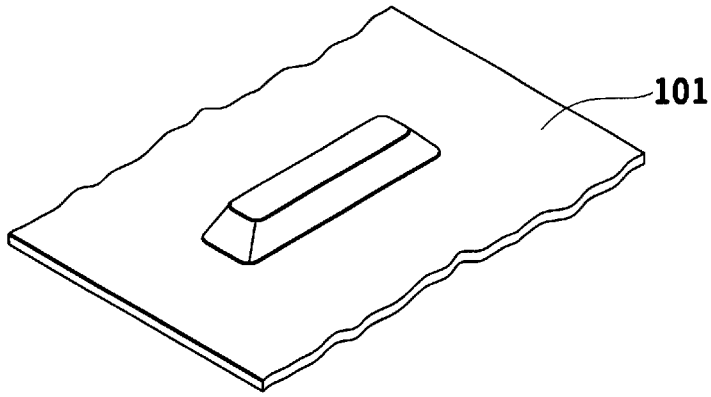
Figure 10C:
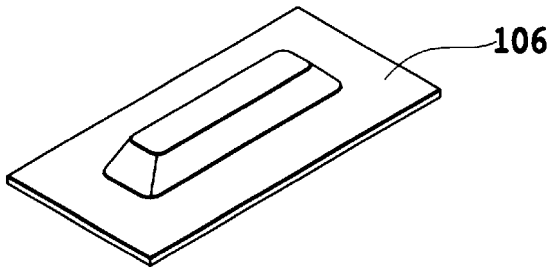

First, FIGS. 10A, 10B, and 10C are illustrations of steps of forming the flexible tank sheet 106 with a convex shape.

A sheet material 101 for forming the tank sheet 106 is formed from a raw material into a sheet having a large size, and the sheet material 101 is an important factor of the performance of the ink tank. The sheet material 101 has low permeability against gases and ink components, flexibility, and durability against repeated deformation. Such preferable materials include PP, PE, PVDC, EVOH, nylon, and composite materials with deposited aluminum, silica or the like. It is also possible to use such materials by laminating them. In particular, excellent ink tank performance can be achieved by laminating PP or PE that has high chemical resistance and PVDC that exhibits high performance in blocking gases and vapors. The thickness of such a sheet material 101 is preferably in the range from about 10 $\mu$m to 100 $\mu$m taking softness and durability into consideration.

As shown in FIG. 10A, such a sheet material 101 is formed into a convex shape using a forming die 102 having a convex portion 103, a vacuum hole 104, and a temperature adjusting mechanism (not shown). The sheet material 101 is absorbed by the vacuum hole 104 and formed into a convex shape that is compliant with the convex portion 103 by heat from the forming die 102. After being formed into the convex shape as shown in FIG. 10B, the sheet material 101 is cut into a tank sheet 106 having a predetermined size as shown in FIG. 10C. The size is only required to be suitable for manufacturing apparatus at subsequent steps and may be set in accordance with the volume of the ink tank 127 for containing ink.

Figure 11A:
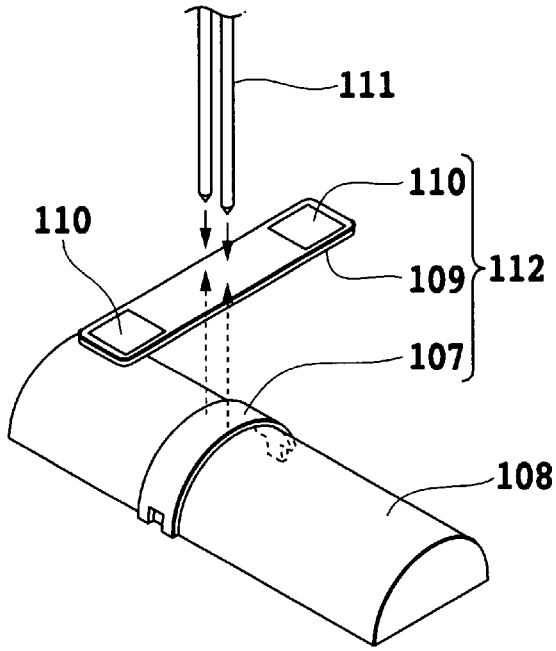
FIG. 11A is an illustration of a step of manufacturing a spring unit of the ink tank in FIG. 9.

FIG. 11A is an illustration of a step of manufacturing the spring unit 112 used for generating a negative pressure in the ink tank 127. A spring 107 that is formed in a semicircular configuration in advance is mounted on a spring receiving jig 108, and a pressure plate 109 is attached to the same from above through spot welding using a welding electrode 111. A thermal adhesive 110 is applied to the pressure plate 109. A spring unit 112 is constituted of the spring 107 and the pressure plate 109.

Figure 11B:
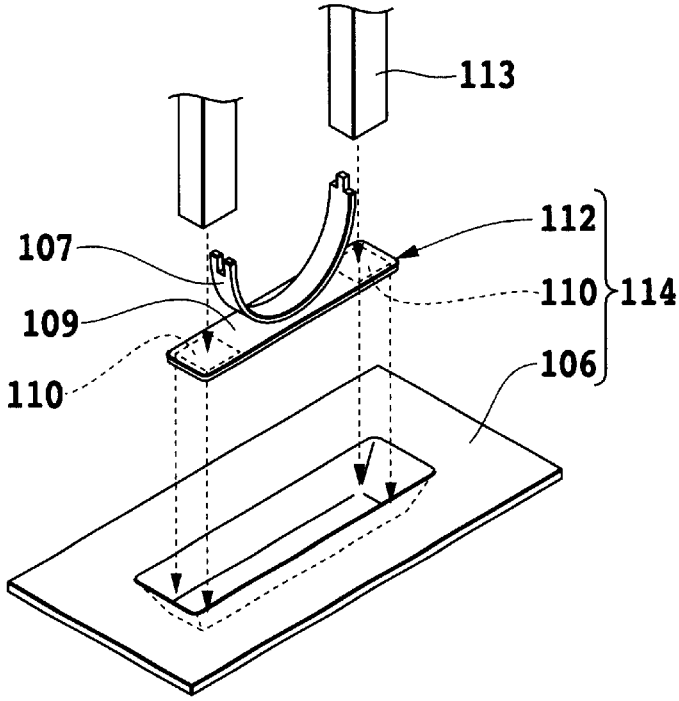
FIG. 11B is an illustration of a step of manufacturing a spring/sheet unit of the ink tank in FIG. 9.

FIG. 11B is an illustration of a step of mounting a spring unit 112 to the tank sheet 106. The spring unit 112 is positioned on an inner surface of the tank sheet 106 placed on a receiving jig (not shown). The thermal adhesive 110 is heated using a heat head 113 to bond the spring unit 112 and the tank sheet 106 to form a spring/sheet unit 114.

Figure 12A:
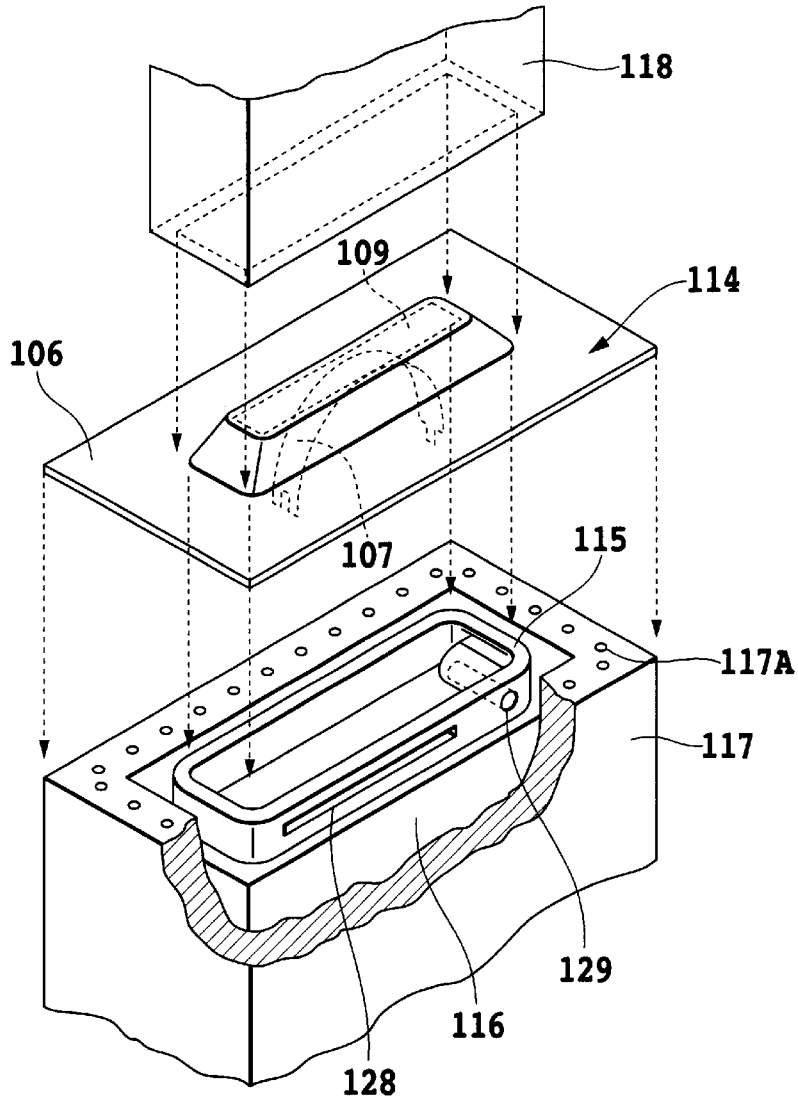
FIGS. 12A and 12B are illustrations of a spring/sheet/frame unit of the ink tank in FIG. 9.

FIG. 12A is an illustration of a step of welding the spring/sheet unit 114 to the frame 115. The frame 115 is secured to a frame receiving jig 116. After the flame 115 is positioned and placed on the jig 116, a sheet absorbing jig 117 surrounding the frame 115 absorbs the spring/sheet unit 114 to a vacuum hole 117A to hold the unit 114 and the frame 115 without relative misalignment. Thereafter, a heat head 118 is used to thermally weld annular joint surfaces of a top side circumferential edge of the frame 115 in FIG. 12A and a circumferential edge of the tank sheet 106 of the spring/sheet unit 114. Since the sheet absorbing jig 117 sets the top circumferential edge of the frame 115 in FIG. 12A and the circumferential edge of the tank sheet 106 of the spring/sheet unit 114 in a uniform face-to-face relationship, the bonding surfaces are quite uniformly thermally welded and sealed. Therefore, the sheet absorbing jig 117 is important for thermal welding in order to provide uniform sealing.

Figure 12B:
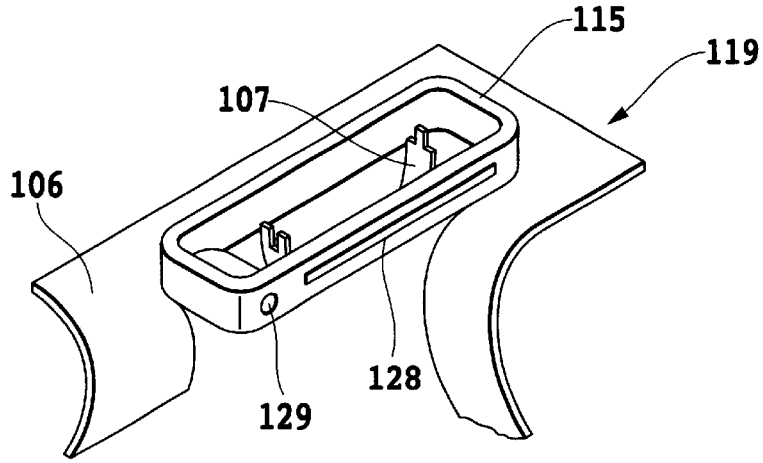

FIG. 12B is an illustration of a step of cutting off a part of the tank sheet 106 protruding from the frame 115 with a cutter (not shown). A spring/sheet/frame unit 119 is completed by cutting off the part of the tank sheet 106 protruding from the frame 115.

Figure 13:
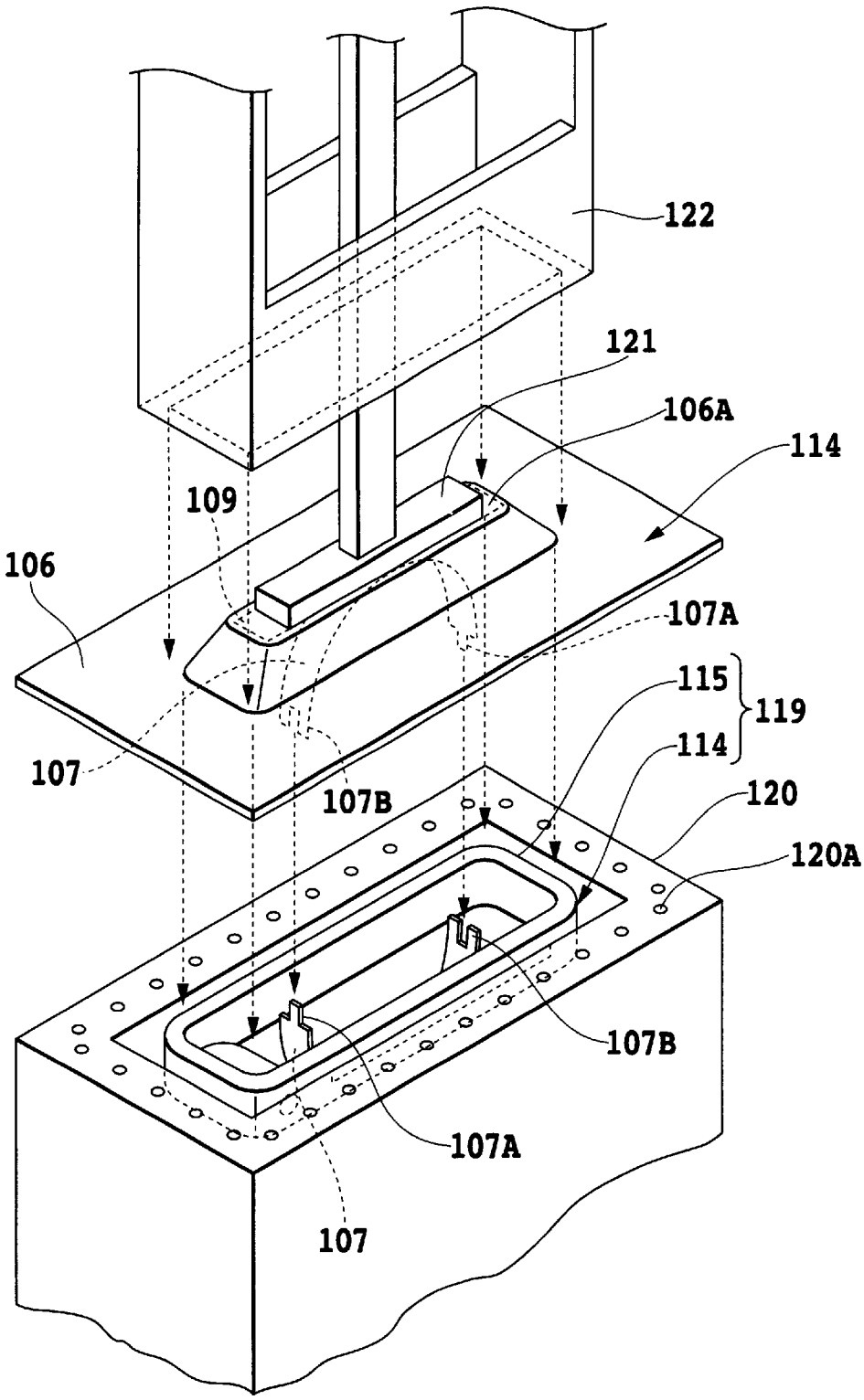
FIG. 13 is an illustration of a step of combining the spring/sheet unit and the spring/sheet/frame unit of the ink tank in FIG. 9.
Figure 14A:
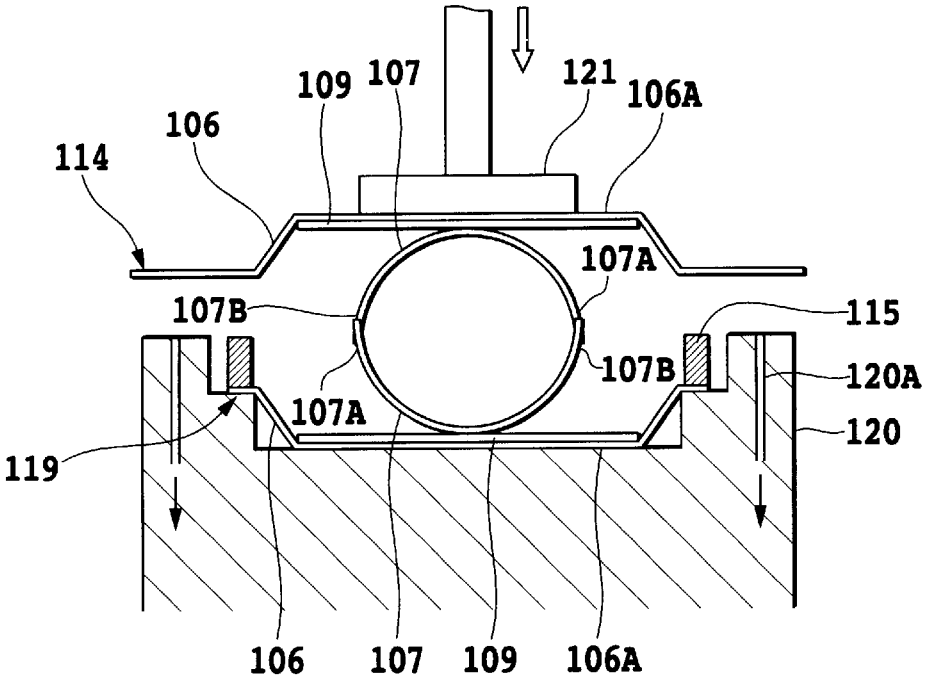
FIGS. 14A and 14B are sectional views of major parts at the combining step shown in FIG. 13.
Figure 14B:
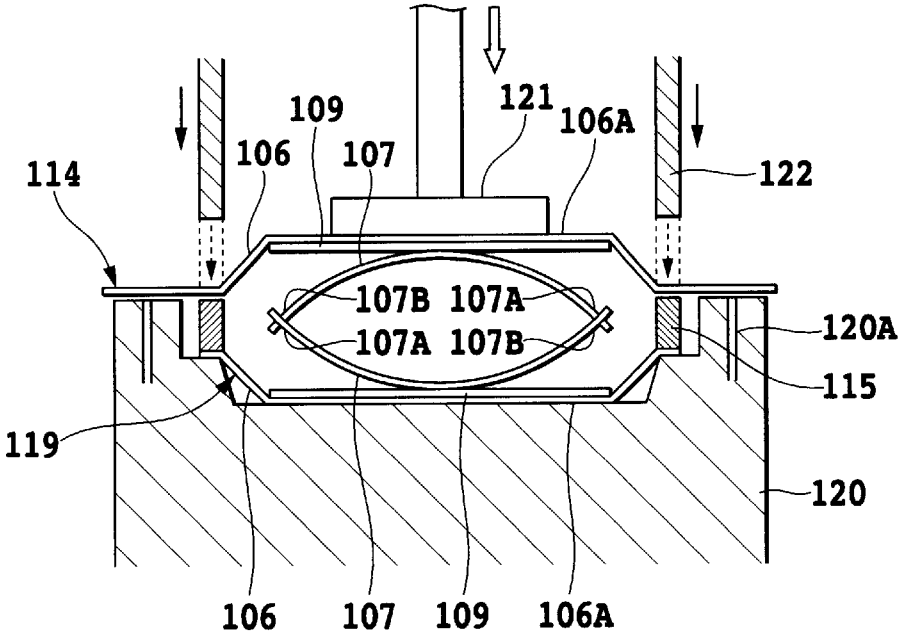

FIG. 13, FIG. 14A, and FIG. 14B are illustrations of steps of thermally welding another spring/sheet unit 114 fabricated through the above-described steps to such a spring/sheet/frame unit 119.

As shown in FIG. 13, the spring/sheet/frame unit 119 is mounted on a receiving jig (not shown), and the periphery of the spring/sheet/frame unit 119 is surrounded by an absorbing jig 120 whose position is defined relative to the receiving jig. The receiving jig is in surface contact with an outer planar section 106A of the tank sheet 106 of the spring/sheet/frame unit 119 to hold the planar section 106A as shown in FIGS. 14A and 14B. The other spring/sheet unit 114 is absorbed and held by a holding jig 121 at an outer planar section 106A of the tank 106 thereof. The holding jig 121 then is lowered to fit ends 107A and 107B of the spring 107 of the spring/sheet unit 114 and ends 107A and 107B of the spring 107 of the spring/sheet/frame unit 119 substantially simultaneously. The ends 107A of the springs 107 have a convex shape, and the other ends 107B have a concave shape, which causes them to fit each other respectively an a self-alignment basis. A single spring member is formed with combining those springs 107 as a pair of spring member forming bodies.

The holding jig 121 is further lowered to compress the pair of springs 107 as shown in FIG. 14A. In doing so, the holding jig 121 widely presses the top planar section 106A of the spring/sheet unit 114 in FIG. 13, i.e., a top flat region of the tank sheet 106 that is formed in a convex configuration. As a result, the position of the planar section 106A of the tank sheet 106 is regulated, and the spring/sheet unit 114 approaches the unit 119 and the jig 120 located below the same while being kept in parallel with them. Therefore, as shown in FIG. 14B, the circumferential edge of the tank sheet 106 of the spring sheet unit 114 is absorbed and held at the vacuum hole 120A in contact with a surface of the absorbing jig 120, and it is also put in a uniform face-to-face relationship with the welding surface (the top joint surface in the same figure) of the frame 115. In this state, annular joint surfaces of the top circumferential edge of the frame 115 of the spring/sheet/frame unit 119 and the tank sheet 106 of the spring/sheet unit 114 are thermally welded to each other with a heat head 122.

By compressing the pair of springs 107 while thus maintaining parallelism between the planar section 106A of the tank sheet 106 of the upper unit 114 and the planar section 106A of the tank sheet 106 of the lower unit 119, ink tanks 127 having high parallelism between the planar sections 106A of the pair of tank sheets 106 thereof can be produced on a mass production basis with stability. Since the pair of springs 107 are symmetrically and uniformly compressed and deformed in FIGS. 14A and 14B, there will be no force that can incline the spring/sheet unit 114, which makes it possible to produce ink tanks 127 having high parallelism between the planar sections 106A of the pair of tank sheets 106 thereof with higher stability. Further, since the pair of springs 107 are symmetrically and uniformly compressed and deformed in FIGS. 14A and 14B, the interval between the planar sections 106A of the pair of tank sheets 106 in a face-to-face relationship changes with higher parallelism maintained, which consequently makes it possible to supply ink with stability. Further, the ink tank 127 has high sealing property, pressure resistance, and durability because no force acts to incline the planar section 106A of the flexible tank sheet 106.

Thereafter, the part of the tank sheet 106 protruding from the frame 115 is cut off to complete the ink tank 127 as shown in FIG. 9. The interior of the ink tank 127 has an enclosed structure that is in communication with the outside only through the first ink supply port 128 and the second ink supply port 129.

Figure 15:
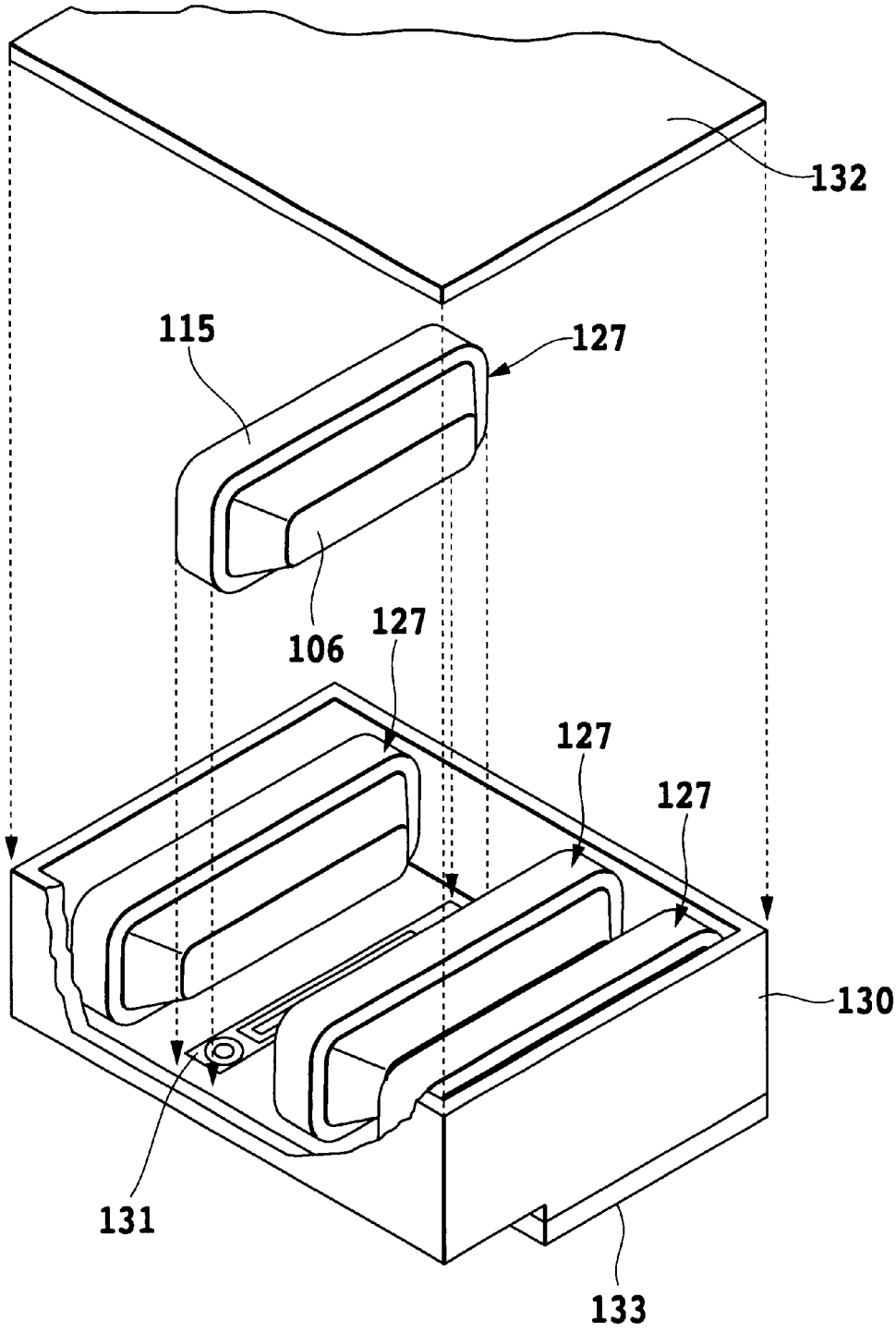
FIG. 15 is an illustration of a step of mounting the ink tank in FIG. 9.

FIG. 15 is an illustration of a step of mounting the ink tank (the sub-tank) 127 to a printing head.

A head chip 133 serving as a printing head is mounted in an ink tank containing chamber 130, and a plurality of ink tanks 127 are mounted in the ink tank containing chamber 130. The ink tanks 127 are mounted to an ink tank mounting section 131 using welding or bonding. The ink tanks 127 of the present embodiment are mounted with the ink supply ports 128 and 129 located on the bottom thereof. Thereafter, a lid 132 is mounted to an opening of the ink tank containing chamber 130 using welding or bonding to form a semi-enclosed space in the ink tank containing chamber 130. A printing head having ink tanks is thus configured. The head chip 133 may serve as an inkjet printing head. The inkjet printing head may have a configuration in which an electrothermal transducer is provided to eject ink droplets from an ink ejection port, for example. Specifically, a configuration may be employed in which film boiling of ink is caused by heat generated by the electrothermal transducer and in which ink droplets are ejected from the ink ejection port utilizing the foaming energy. An inkjet cartridge can be configured by combining such an inkjet printing head and ink tanks.

Figure 16:
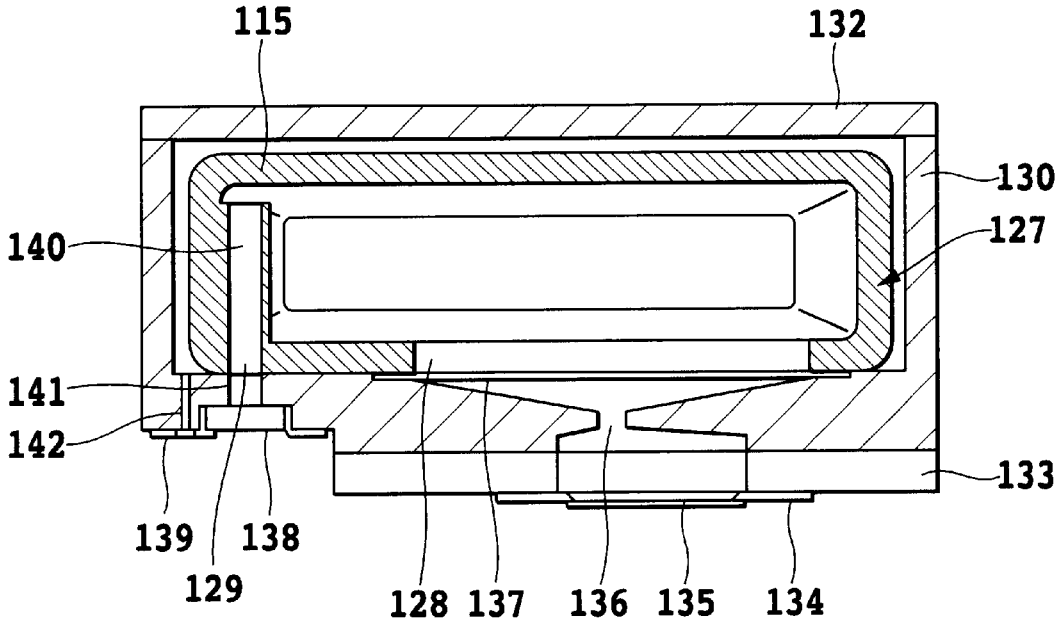
FIG. 16 is a sectional view of major parts of the ink tank in FIG. 15 in a mounted state.

FIG. 16 is a sectional view of the ink tank containing chamber 130 in FIG. 15 having ink tanks therein.

Ink can be reserved in the ink tanks 127, and the ink is supplied from the first ink supply ports 128 of the ink tanks 127 to a supply channel 136 through a filter 137 and is then further supplied to the head chip 133. A heater board 134 is bonded to the head chip 133 of the present embodiment to form an inkjet printing head. The heater board 134 is formed with ink paths and orifices and is provided with electrothermal transducers (heaters) to be able to eject ink supplied from the ink tanks 127. The ink tanks 127 can be charged with ink through the second supply ports 129. Specifically, a joint seal 138 for preventing ink leakage and allowing ink charging is secured to the second ink supply port 129 with a joint seal plate 139 such that it seals an opening 141 at the bottom of the ink tank containing chamber 130. The joint seal 138 is constituted by a flexible rubber member and provided with a slit into which a supply pipe in the form of a needle can be inserted. When ink is supplied to the ink tank 127, the needle-like supply pipe is inserted into the slit of the joint seal 138, and ink is supplied to the ink tank 127 through the supply pipe. When ink is not supplied to the ink tank 127, since the slit is closed because of the elasticity of the joint seal 138, ink will not leak out. Reference numeral 140 represents a communication channel that is in communication with the second supply port 129, and the communication channel may be formed in advance such that it extends through the frame 115.

The ink tank containing chamber 130 having the generally enclosed structure formed by the lid 132 is in communication with the outside only through a small hole 142. The interior of the ink tank containing chamber 130 can be isolated from the atmosphere by closing the small hole 142. The pressure in the ink tank containing chamber 130 can be reduced to increase a negative pressure in the ink tanks 127 by exhausting air from the ink tank containing chamber 130 through the small hole 142.

Ink can be automatically suctioned and supplied into the ink tanks 127 through the second ink supply ports 129 by repeating depressurization and pressurization of the interior of the ink tank containing chamber 130. At this time, since the springs 107 are elastically deformed with high responsiveness to changes in the pressure in the ink tank containing chamber 130, the ink tanks can be preferably used as compact ink tanks that are frequently replenished with ink.

Instead of a pair of springs 107, a single spring may be provided which has a configuration that is similar to the combination of the two springs. In this case, the single spring may be mounted to one of a pair of tank sheets 106; the tank sheet 106 may then be coupled with a frame 115; and the other tank sheet 106 may be coupled with the frame 115 while compressing the single spring. In doing so, the single spring may be simply sandwiched between the pair of tank sheets 106 instead of mounting it to the other one of the pair of tank sheets 106.

At least either of the pair of tank sheets 106 may be constituted by a flexible member.

(First Embodiment)

A configuration of a sub-tank according to the present invention will now be described with reference to FIGS. 3 to 5.

An accumulated gas discharge mechanism according to the present invention is used in a sub-tank manufactured according to the above-described method of manufacture. The accumulated gas discharge mechanism according to the present invention also serves as an ink supply mechanism.

Figure 3A:
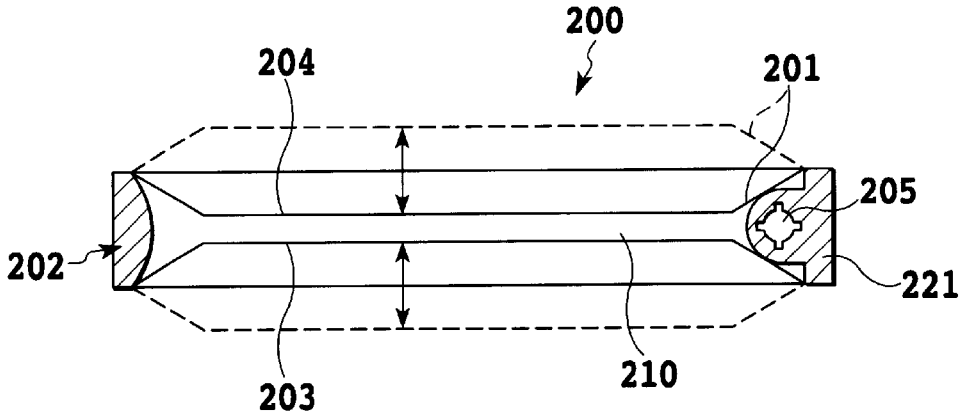
FIGS. 3A and 3B shows schematic sectional views of a sub-tank utilizing an ink supply/accumulated gas discharge mechanism as a first embodiment of the present invention, FIG. 3A being a horizontal sectional view of the sub-tank, FIG. 3B being a vertical section view of the sub-tank.
Figure 3B:
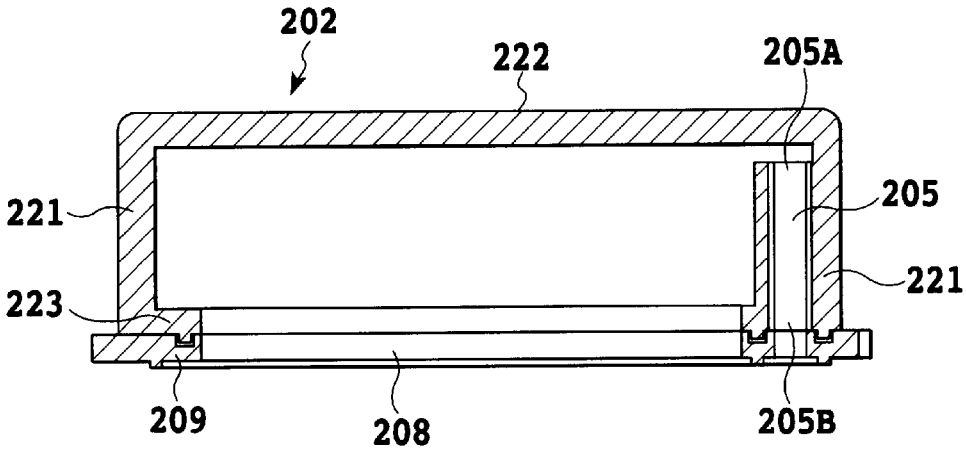
Figure 4:
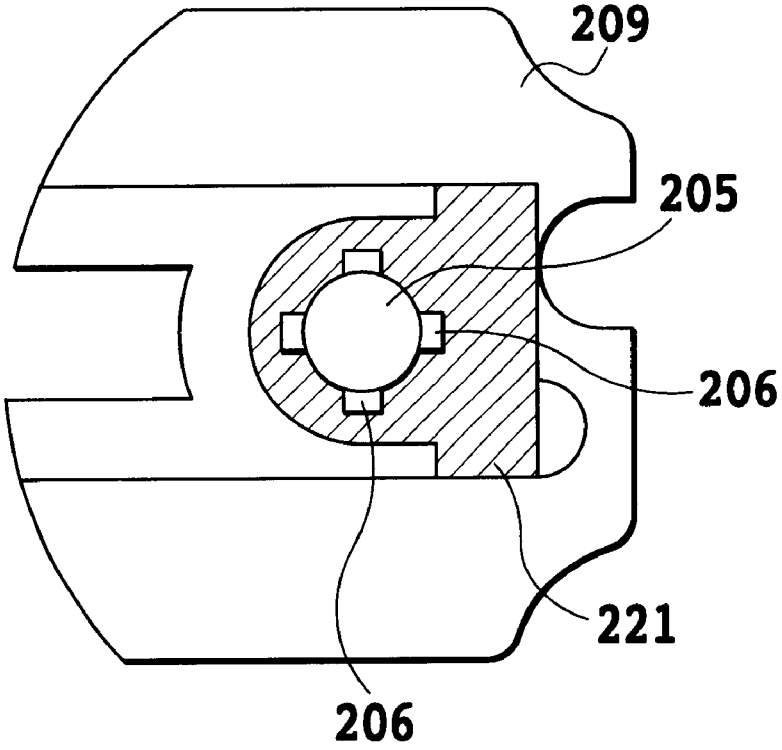
FIG. 4 is a schematic enlarged horizontal sectional view of the supply/discharge channel in FIGS. 3A and 3B.

FIGS. 3A and 3B are schematic sectional views of a sub-tank (which corresponds to the ink tank 127 in the above description of the manufacturing method) that a first embodiment of an ink supply/accumulated gas discharge mechanism according to the present invention is utilized. FIG. 3A is a horizontal sectional view of the sub-tank, and FIG. 3B is a vertical sectional view of the sub-tank. FIG. 4 is a schematic enlarged horizontal sectional view of the supply/discharge channel in FIGS. 3A and 3B, and FIG. 5 is a schematic enlarged vertical sectional view of the supply/discharge channel in FIGS. 3A and 3B.

Referring to those figures, a sub-tank 200 is constituted by deformable film sheets 201, a frame 202, a pair of pressure plates 203 and 204, and a pair of plate springs 210 for generating a negative pressure in the sub-tank 200, as described above. FIG. 3A shows a state in which ink in the sub-tank 200 has been used to constrict the sub-tank 200. The dotted line in FIG. 3A indicates a fully loaded state of the sub-tank 200. A plurality of the sub-tanks 200 are provided in an ink tank containing chamber (which corresponds to the ink tank containing chamber 130 in the above description of the manufacturing method) of an inkjet printing head which is not shown. Each sub-tank movable section constituted by film sheets 201, a pair of pressure plates 203, 204 and a pair of plate springs 210 as described above is provided substantially in parallel with a bottom wall of the ink tank containing chamber (i.e., such that the frame 202 is perpendicular to the bottom wall of the ink tank containing chamber).

Reference numeral 205 represents a supply/discharge channel that serves as an ink supply mechanism for supplying ink to the sub-tank and also as an accumulated gas discharge mechanism for discharging gases that have entered and accumulated in the sub-tank. As shown in FIGS. 3B and 5, the supply/discharge channel 205 is formed such that it extends in the vertical direction in a vertical frame 221 forming a part of the frame 202 and constituting a side section of the sub-tank. An opening 205A of the channel 205 is provided in an upper part of the sub-tank 200. By forming the opening 205A of the supply/discharge channel 205 in an upper part of the sub-tank 200 in such a manner, gases accumulated (collected) in the upper part of the sub-tank can be efficiently discharged.

The supply/discharge channel 205 is preferably provided in a position where it does not interfere with the movable section that forms a part of the sub-tank, i.e., a dead space in the sub-tank. When provided in such a position, the supply/discharge channel 205 shall neither hinder the movement of the movable section nor reduce the consuming efficiency of ink in the sub-tank. Further, the ink capacity of the sub-tank 200 can be maximized by providing the supply/discharge channel 205 in the frame 202 as in the present embodiment. The supply/discharge channel 205 may be formed as a vertical pipe provided in a dead space in the sub-tank 200 apart from the vertical frame 221.

Reference numeral 206 represents a groove formed along the supply/discharge channel 205 and an appropriate number of the grooves are provided as required. In the present embodiment, four grooves 206 are provided as shown in FIG. 4. Reference numeral 207 represents an ink supply/accumulated gas discharge needle that is inserted in the supply/discharge channel 205 and the needle 207 has an opening 212 at the tip thereof. Reference numeral 209 represents a base that is integrally mounted to a bottom frame 223 for positioning and fixing the sub-tank 200 on the bottom wall of the ink-tank containing chamber of the inkjet printing head. Reference numeral 208 represents an ink supply port provided at the bottom frame 223 and the base 209 constituting the bottom of the sub-tank 200 for supplying ink in the sub-tank to the printing head (not shown).

A description will now be made with reference to FIGS. 3A, 3B, and 5 on ink supply and accumulated gas discharge operations in the sub-tank 200 having the above configuration.

Figure 5:
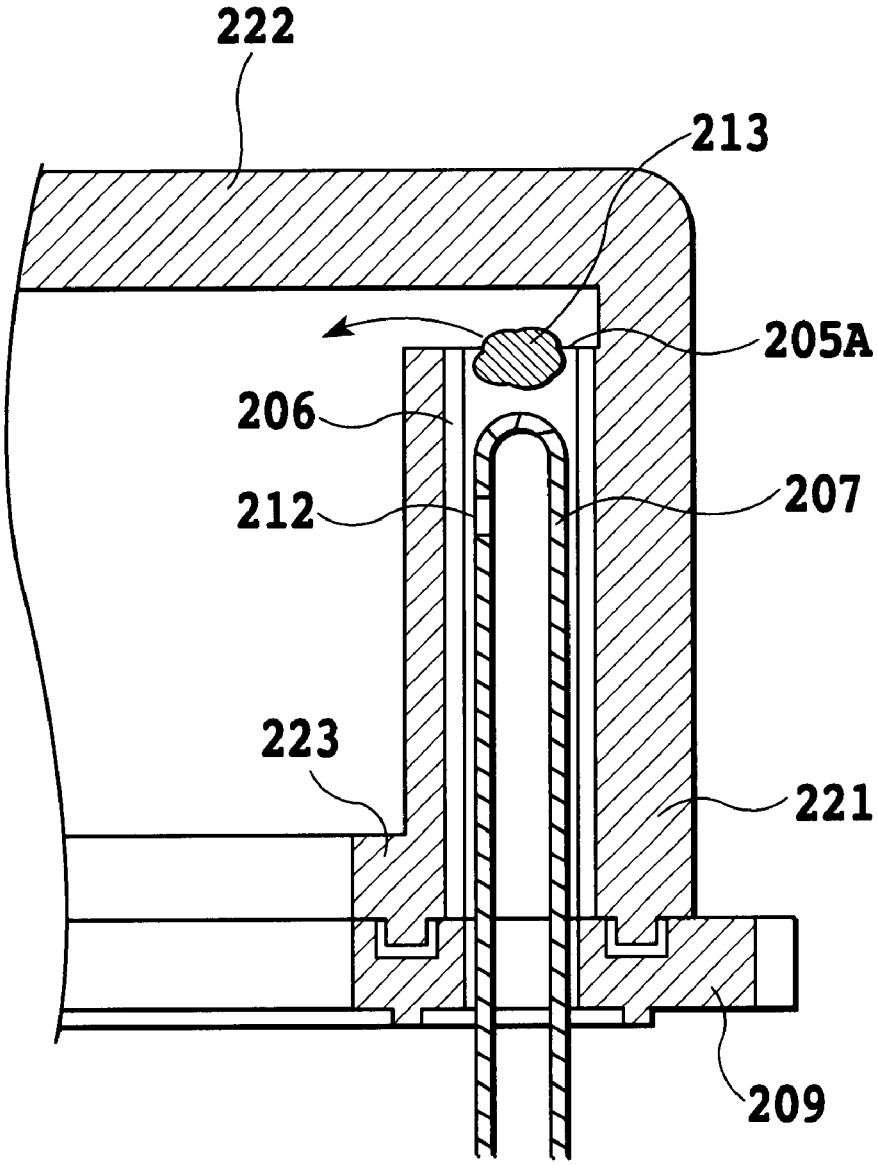
FIG. 5 is a schematic enlarged vertical sectional view of the supply/discharge channel in FIGS. 3A and 3B.

When the ink supply/accumulated gas discharge needle 207 is inserted in the supply/discharge channel 205 (or when a valve unit 51 of a printing head unit side and a valve unit 54 of an ink supplying side are connected as shown in FIG. 1 to connect the sub-tank 200 and the main tank 57), ink deposits or thickened ink 213 that has been accumulated in the supply/discharge channel 205 are discharged into the sub-tank 200 through the opening 205A of the supply/discharge channel 205, as shown in FIGS. 3A, 3B, and 5. This indicates that the operation of inserting the needle 207 has an effect of cleaning the supply/discharge channel 205. The deposits 213 discharged into the sub-tank 200 are discharged from the tank through a printing head unit 1 during a recovery operation of the printing head unit 1.

A valve unit 52 of the printing head side and a valve unit 53 of an air pump side are connected at the same time to couple the air pump with the ink tank containing chamber.

When air is sucked from the ink tank containing chamber with an air pump 58 in this state to generate a negative pressure in the containing chamber, the sub-tank 200 expands. Then, the negative pressure in the sub-tank 200 increases accordingly to allow ink to be supplied from the main tank 57 to the sub-tank 200 consequently. Conversely, when air is supplied into the ink tank containing chamber with the air pump 58 to pressurize the interior of the containing chamber, the sub-tank 200 constricts. Then, gases accumulated in the sub-tank 200 can be discharged to the main tank 57 along with the ink in the sub-tank 200. The gases discharged in the main tank 57 can be released to the atmosphere since the main tank 57 is exposed to the atmosphere, and the returned (discharged) ink can be used again.

The inner diameter of the ink supply/accumulated gas discharge needle 207 is preferably made as great as possible to reduce pressure loss in the channel when ink is supplied or discharged. This can make the clearance between the supply/discharge channel 205 and the outer diameter of the needle 207 small to increase pressure loss at the opening 212 of the needle 207. In order to avoid this, in the present embodiment, the supply/discharge channel 205 has a configuration including the grooves 206 as shown in FIG. 4. This provides a clearance between the supply/discharge channel 205 and the opening 212 of the needle not to hinder ink from flowing.

Although four grooves 206 are provided in the present embodiment, this is not limiting the present invention. Referring to the configuration of the supply/discharge channel 205, the same effect can be achieved by employing a configuration having an elliptic horizontal section or spiral grooves instead of the linear grooves 206 in the present embodiment.

(Other Embodiments)

Figure 6A:
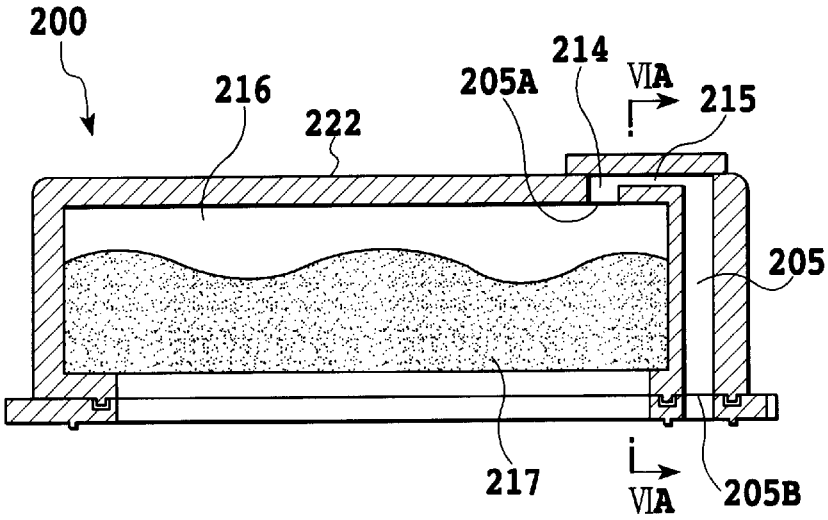
FIGS. 6A and 6B are schematic sectional views of a sub-tank utilizing an ink supply/accumulated gas discharge channel as a second embodiment of the present invention, FIG. 6A being a vertical sectional view of the sub-tank, FIG. 6B being a sectional view taken along the line A—A in FIG. 6A.
Figure 6B:
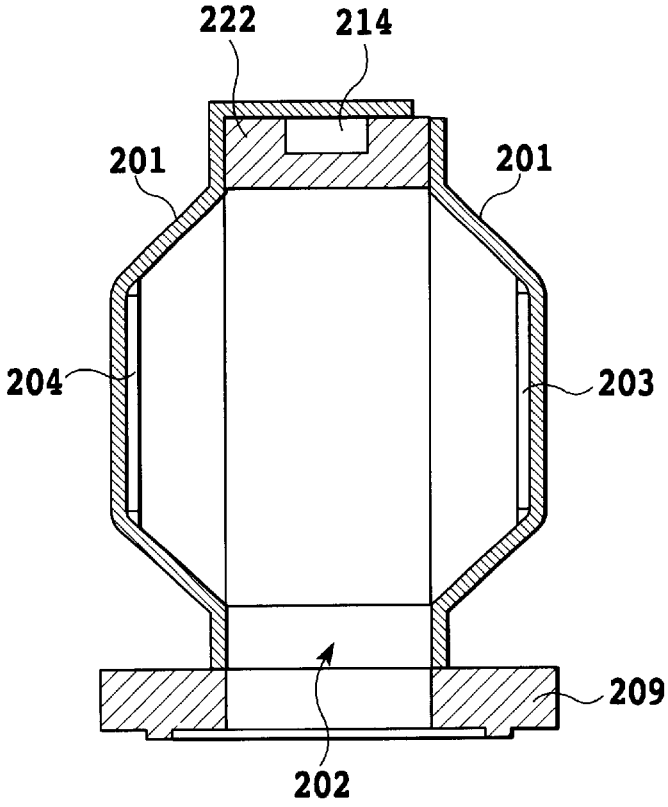

FIGS. 6A and 6B show a second embodiment of the present invention. The present embodiment is different from the first embodiment in the position of an opening in an upper part of a supply/discharge channel 205. Specifically, in the present embodiment, a supply/discharge channel 205 penetrates through a vertical frame 221 forming a part of a frame 202 and connects to an opening 205A formed at a ceiling section of a sub-tank 200 through a horizontal channel 215 formed in a top horizontal frame 222. Since gases 216 that have entered the sub-tank 200 are accumulated in an upper part of the sub-tank (in the direction opposite to the direction of gravity) as described above, the gases accumulated in the upper part can be discharged with efficiency higher than that of the first embodiment regardless of the level of ink 217 in the sub-tank 200 by discharging the accumulated gases 216 through the opening 205A of the supply/discharge channel 205.

In the present embodiment, the horizontal channel 215 is formed by removing a top surface of the top horizontal frame 222 for reasons associated with the die structure and processing of the top horizontal frame 222. Therefore, in order to configure the horizontal channel 215, the opening on the top surface must be sealed by thermally welding a seal material 214 for example, as shown in FIG. 6A. A film sheet 201 that forms a part of the sub-tank 200 may be extended and used as the seal material as shown in FIG. 6B.

As a modification of the present embodiment, instead of providing the supply/discharge channel 205 extending upward from a lower part of the tank as in the present embodiment and forming another opening 205B of the supply/discharge channel (an opening at the side thereof connected to the main tank that supplies ink) in a lower part of the tank, the horizontal channel 215 formed in the top horizontal frame 222 may be extended in the horizontal direction to form the opening 205B in a side section of the sub-tank, thereby allowing the needle 207 to be inserted in the horizontal direction. Alternatively, the supply/discharge channel 205 may be horizontally formed along and under a bottom surface of the top horizontal frame 222 (the ceiling section of the sub-tank), and the second opening 205B may be formed in a side section of the sub-tank similarly.

Figure 7:
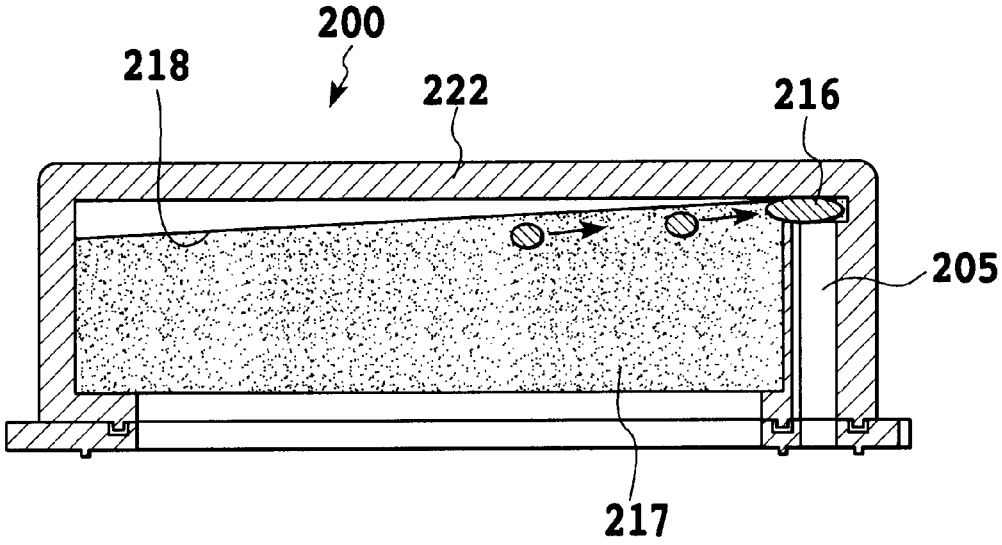
FIG. 7 is a schematic sectional view of a sub-tank utilizing an ink supply/accumulated gas discharge channel as a third embodiment of the present invention.
Figure 8:
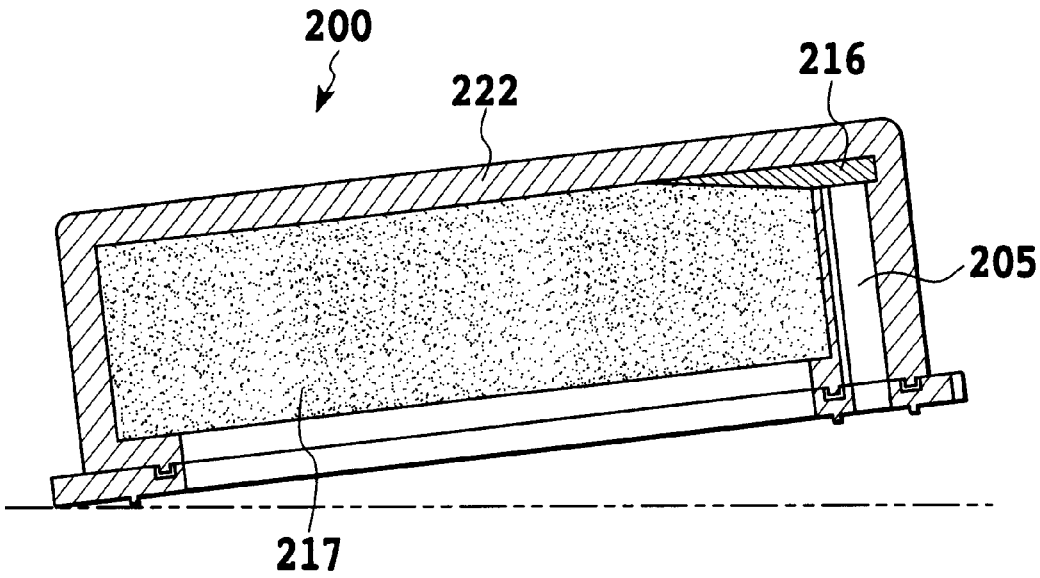
FIG. 8 is a schematic sectional view of a sub-tank utilizing an ink supply/accumulated gas discharge channel as a fourth embodiment of the present invention.

FIGS. 7 and 8 show third and fourth embodiments of the invention in which accumulated gases 216 can be discharged with higher efficiency.

Referring to FIG. 7, a top surface (ceiling section) of a sub-tank 200 that is an ink container is formed with a slope 218. Specifically, a bottom surface of a top horizontal frame 222 forming a part of a frame 202 of the sub-tank 200 is formed as an inclined surface ascending toward an opening of a supply/discharge channel 205. Since accumulated gases 216 are collected in the vicinity of an opening 205A of the supply/discharge channel 205 in such a configuration, the accumulated gases 216 can be easily and efficiently discharged. In the embodiment shown in FIG. 7, the volumetric capacity of the sub-tank is slightly reduced by the slope 218 provided at the ceiling section of the sub-tank. As a measure to solve this problem without losing the same effect, the sub-tank may be installed in an inclined attitude in an ink tank containing chamber as shown in FIG. 8. Alternatively, an ink tank containing chamber containing a plurality of the sub-tanks may be installed in an inclined attitude in a printing head.

As described above, an inkjet printing head according to the present invention comprises a sub-tank which has a movable section constituted by deformable film sheets, a spring for generating a negative pressure, a supply/discharge channel for supplying ink and discharging accumulated gases, and which is intermittently supplied with ink from a main tank and reserves the ink. The printing head according to the present invention also comprises a configuration in which the supply/discharge channel of the sub-tank is provided in a position where it does not interfere with the movable section and the spring. Therefore, this allows the sub-tank to be constricted until the ink therein is substantially used up, which makes it possible to improve ink consuming efficiency and to reduce the frequency of ink supply from the main tank.

Further, since the supply/discharge channel is formed in a frame of the sub-tank, the sub-tank can be provided with a great liquid (ink) containing capacity and manufactured easily.

Since an opening of the supply/discharge channel is provided in an upper part of the sub-tank or at a ceiling section of the same that is the top section thereof, gases that have entered and accumulated in the sub-tank can be easily and efficiently discharged without hindering ink supply in spite of the simple structure. In addition, accumulated gases can be more easily and efficiently discharged by tilting a bottom surface of the ceiling section.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An inkjet printing head comprising a sub-tank, the sub-tank being configured to reserve ink to be supplied to said inkjet printing head and to communicate with a main tank and be supplied with ink from the main tank, the sub-tank comprising:

a movable section constituted by a deformable film sheet and defining a space for reserving ink;

a spring which is mounted on the movable section and which serves to generate a negative pressure within said sub-tank with respect to said inkjet printing head; and a channel for rendering the space defined by said movable section communicable with the outside, said channel being supplied with ink from the main tank by displacing said movable section and said spring so as to change a volume of the space, and said channel being used to discharge gases trapped within the space from the space to the outside, wherein said channel is provided in a position where said channel does not interfere with said movable section and a displaceable portion of said spring.

2. An inkjet printing head as claimed in claim 1, wherein said sub-tank has a frame and wherein said channel is formed integrally with said frame.

3. An inkjet printing head as claimed in claim 1, wherein an opening of said channel is formed in an upper part of said sub-tank.

4. An inkjet printing head as claimed in claim 1, wherein an opening of said channel is formed at a ceiling section of said sub-tank.

5. An inkjet printing head as claimed in claim 4, wherein a channel section of said channel formed at said ceiling section of said sub-tank is sealed with the film sheet that constitutes said movable section of said sub-tank.

6. An inkjet printing head as claimed in claim 1, wherein a ceiling section of said sub-tank is inclined toward an opening of said channel.

7. An inkjet printing head as claimed in claim 1, wherein at least one groove is formed along said channel.

8. An inkjet printing head as claimed in claim 1, wherein at least one sub-tank is disposed in a tank-containing chamber in which a positive pressure or negative pressure is generated with a pump.

9. An inkjet printing head as claimed in claim 8, wherein the volume of the space is changed by the displacement of said movable section due to the positive or negative pressure applied by the pump, whereby said sub-tank is supplied with ink from the main tank and discharges gases trapped within the space to the outside.

10. An inkjet printing head as claimed in claim 1, wherein said channel is configured to receive a tube member which communicates with the main tank and which is for supplying ink and for discharging gases, and said channel is configured to extend from a bottom of said sub-tank upward in the direction of gravity in a state in which said sub-tank is operational.

* * * * *